US009675158B2

(12) United States Patent
Soresina et al.

(10) Patent No.: US 9,675,158 B2
(45) Date of Patent: Jun. 13, 2017

(54) NOZZLE FOR HAIR DRYER

(71) Applicants: Claudio Soresina, Morbio Inferiore (CH); Flavio Soresina, Mendrisio (CH)

(72) Inventors: Claudio Soresina, Morbio Inferiore (CH); Flavio Soresina, Mendrisio (CH)

( * ) Notice: Subject to any disclaimer, the term of this patent is extended or adjusted under 35 U.S.C. 154(b) by 0 days.

(21) Appl. No.: 14/767,339

(22) PCT Filed: Mar. 11, 2014

(86) PCT No.: PCT/IB2014/000282
§ 371 (c)(1),
(2) Date: Aug. 12, 2015

(87) PCT Pub. No.: WO2014/147460
PCT Pub. Date: Sep. 25, 2014

(65) Prior Publication Data

US 2015/0366316 A1 Dec. 24, 2015

(30) Foreign Application Priority Data

Mar. 18, 2013 (IT) ..... RM2013A0166

(51) Int. Cl.
*A45D 20/12* (2006.01)

(52) U.S. Cl.
CPC ..... *A45D 20/12* (2013.01)

(58) Field of Classification Search
CPC ..... A45D 1/00; A45D 20/00; A45D 20/12; F26B 19/00; F26B 23/00; F26B 25/00
(Continued)

(56) References Cited

U.S. PATENT DOCUMENTS 2,420,732 A * 5/1947 Bichsel ..... A45D 20/10 34/97
3,943,329 A 3/1976 Hlavac
(Continued)

FOREIGN PATENT DOCUMENTS

DE 10231058 A1 * 1/2004 ..... A45D 20/12
DE WO 2004006712 A1 * 1/2004 ..... A45D 20/12
(Continued)

OTHER PUBLICATIONS

International Search Report, dated May 19, 2014, from corresponding PCT application.
(Continued)

*Primary Examiner* — Stephen M Gravini
(74) *Attorney, Agent, or Firm* — Young & Thompson

(57) ABSTRACT

A front nozzle for hair dryer, includes at least: one outer surface; one tapered portion extending along an axis; one flattened portion extending perpendicularly to the axis in fluid communication with the tapered portion and having a front slit at one end thereof; one main channel for the passage therethrough of air flow coming from the hair dryer, the main channel including at least one converging portion and at least one diverging portion downstream thereof; one secondary channel including at least one opening at the outside of the nozzle and at least one front opening downstream of the converging portion of the main channel to contact the air flow passing through the secondary channel with the main air flow passing through the main channel, the secondary channel extending between the outer surface and the main channel so as to thermally insulate, at least partially, the outer surface.

20 Claims, 5 Drawing Sheets

(58) Field of Classification Search
USPC ..... 34/97, 98, 99; 132/271, 272; 392/384, 392/385; 239/443, 455
See application file for complete search history.

(56) References Cited

U.S. PATENT DOCUMENTS

| | | | | |
|---|---|---|---|---|
| 3,955,065 | A * | 5/1976 | Chambon | A45D 20/10 165/122 |
| 5,649,370 | A | 7/1997 | Russo | |
| 5,725,159 | A * | 3/1998 | Dorber | A45D 20/122 239/553.3 |
| 7,040,037 | B2 * | 5/2006 | Keong | A45D 20/122 34/97 |
| 7,047,660 | B2 * | 5/2006 | Leventhal | A45D 20/122 34/97 |
| 7,065,899 | B2 * | 6/2006 | Lin | F24H 3/0488 34/97 |
| 7,412,781 | B2 * | 8/2008 | Mattinger | F24H 3/0423 34/96 |
| 8,407,913 | B2 * | 4/2013 | Langley | A45D 19/16 132/271 |
| 8,601,713 | B2 * | 12/2013 | Gaillard | A45D 20/12 132/221 |
| 8,959,788 | B2 * | 2/2015 | Hada | A45D 20/10 34/283 |
| 9,144,286 | B2 * | 9/2015 | Courtney | A45D 20/00 |
| 9,173,468 | B2 * | 11/2015 | Moloney | A45D 20/10 |
| 9,282,799 | B2 * | 3/2016 | Courtney | A45D 20/12 |
| 9,282,800 | B2 * | 3/2016 | Courtney | A45D 20/04 |
| 9,414,662 | B2 * | 8/2016 | Moloney | A45D 20/10 |
| 9,420,865 | B2 * | 8/2016 | Gammack | A45D 20/08 |
| 2004/0083620 | A1 | 5/2004 | McCambridge et al. | |
| 2004/0163274 | A1 | 8/2004 | Andrew et al. | |
| 2005/0229422 | A1 | 10/2005 | Mattinger et al. | |

FOREIGN PATENT DOCUMENTS

| | | | |
|---|---|---|---|
| DK | 199900736-0001 | | 6/1999 |
| EM | 000525019-0003 | | 4/2006 |
| ES | 10148988 | | 7/2000 |
| FR | 016371-0002 | | 10/2001 |
| JP | H06327514 | A | 11/1994 |
| JP | 3014299 | A | 5/1995 |
| JP | 09084625 | A * | 3/1997 |

OTHER PUBLICATIONS

Third Party Observation, dated Mar. 11, 2014, from corresponding PCT application.

* cited by examiner

NOZZLE FOR HAIR DRYER

FIELD OF THE ART

The present invention concerns a hair dryer and more particularly a nozzle or concentrator of air flow for hair dryer.

KNOWN ART

The hair dryers are devices used to dry hair both in beauty shops or hairdressers and in domestic use.

Usually, known hair dryers comprise a body having a gun shape composed of an upper element and a grip portion adapted to be grasped by a user.

The upper element, substantially cylindrical or truncated-conical, extends along an axis and has an air inlet at one end and, at the opposite end, an air outlet.

Inside the upper element there are, usually, an electrical motor and a fan, the latter being operated by the afore said motor and able to generate an air flow passing through the upper element and exiting from the front opening. Inside the upper element there is, at a predetermined distance from the motor and the fan, an electric resistance to heat the air flow the fan generated.

Generally, inside the grip portion there is a little control unit, such as a printed circuit, which allows to control the electric motor and consequently the fan and the electric resistance.

The electric motor and the resistance, as well as the printed circuit, are electrically powered and, for this purpose, a power cord connected to the afore said grip portion connects the afore said elements to the electric network.

Known hair driers usually have a front nozzle or flow concentrator, substantially duck-billed shaped, adapted to be mounted on the front opening to direct the air flow and make it converge.

The front nozzles hit by the flow of hot air, which passed the inner resistance of the hair dryer, tend to become heater and heater, thereby reaching high temperatures.

These temperatures make the nozzles difficult to manipulate by the user, most of all by professional users which generally need to touch them in order to replace them with other nozzles having different size or with diffusers or simply because they need to rotate them for changing the flow direction of hot air.

The Applicant further observed that the front nozzles, because of the reached high temperature, can cause burns and/or scorches if contacting the epidermis.

Finally the Applicant observed that, because of the reached high temperature, before the nozzles can be put away in drawers or closed spaces, it is necessary to wait for their cooling so that damages to objects possibly in contact can be prevented.

Therefore the Applicant found the need of solving the afore mentioned issues by providing a front nozzle or concentrator of air flow for hair dryer that allows the maintain temperatures low at portions generally used to contact the user.

SUMMARY OF THE INVENTION

Therefore, in its first aspect the invention relates to front nozzle for hair dryer comprising:

at least one tapered portion extending along an axis (X-X);

at least one flattened portion extending perpendicularly to the axis (X-X); the flattened portion being in fluid connection with the tapered portion and having a front slit at one end thereof;

at least one outer surface comprising an outer surface of the tapered portion and an outer surface of the flattened portion;

at least one main channel for the main air flow, adapted for the passage therethrough of the air flow coming from the hair dryer; said main channel comprising at least one converging portion and at least one second portion placed downstream of the converging portion;

at least one secondary channel comprising at least one opening at the outside of the nozzle and at least one front opening downstream of the converging portion of the main channel to contact the air flow passing through the secondary channel with the main air flow passing through the main channel;

said secondary channel extending between the outer surface and the main channel so as to thermally insulate, at least partially, said outer surface.

In the scope of the present invention with "axial direction" or "axially" it is meant a direction parallel, or anyway just a little sloped, with respect to the X-X axis.

Always in the scope of the present invention with "proximal", "proximally", it is referred to parts or elements arranged in a direction parallel to the X-X axis at the grip portion of the hair dryer, vice versa with "distal", "distally", it is referred to parts or elements arranged in a direction parallel to the X-X axis and axially apart from the grip portion of the hair dryer.

Lastly, with "radial direction", "radially", it is meant a direction substantially orthogonal to the X-X axis.

The present invention, in the afore said aspect, may present at least one of the preferred characteristics hereinafter described.

Preferably, the second portion is a diverging portion.

Alternatively, the second portion is a constant portion.

Preferably, the secondary channel is variable in cross-section along its extent.

Advantageously, the front opening is formed at the diverging portion of the main channel and it is smaller in cross-section than the main channel.

Conveniently, the main channel further comprises a constant portion interposed between the converging portion and the diverging portion.

Preferably, the secondary channel extends over the tapered portion so as to create an air chamber insulating the outer surface of the tapered portion.

Advantageously, the secondary channel extends over the flattened portion so as to create an air chamber insulating the outer surface of the flattened portion.

Preferably, the nozzle has at least one outer jacket and at least one inner jacket.

The outer jacket could overly the inner jacket so as to form the secondary channel as interposed between the respectively inner and outer two jackets.

Conveniently, there is a radial clearance between the outer jacket and the inner jacket along the secondary channel, said radial clearance being variable along the extent of the secondary channel.

Preferably, there is at least one ventilation hole on the outer surface of the flattened portion whereby the exterior of the front nozzle communicates with said secondary channel.

Advantageously, there is a plurality of ventilation holes, said holes having altogether a cross-section in the range from 2 $mm^2$ to 100 $mm^2$.

According to another aspect the present invention concerns a hair dryer comprising a nozzle for hair dryer as previously described.

What described above referring to the afore described nozzle of the first aspect of the invention can be repeated also for the hair dryer provided with a front nozzle of the second aspect of the invention.

BRIEF DESCRIPTION OF THE DRAWINGS

Further characteristics and advantages of the invention will be more evident from the detailed description of some preferred embodiments, but not exclusive, of a hair dryer according to the present invention.

Such a description will be hereinafter explained referring to the attached drawings, provided for purposes of illustrations only, and thereby not limitative, wherein.

DETAILED DESCRIPTION OF SOME EMBODIMENTS OF THE INVENTION

Figure 1:
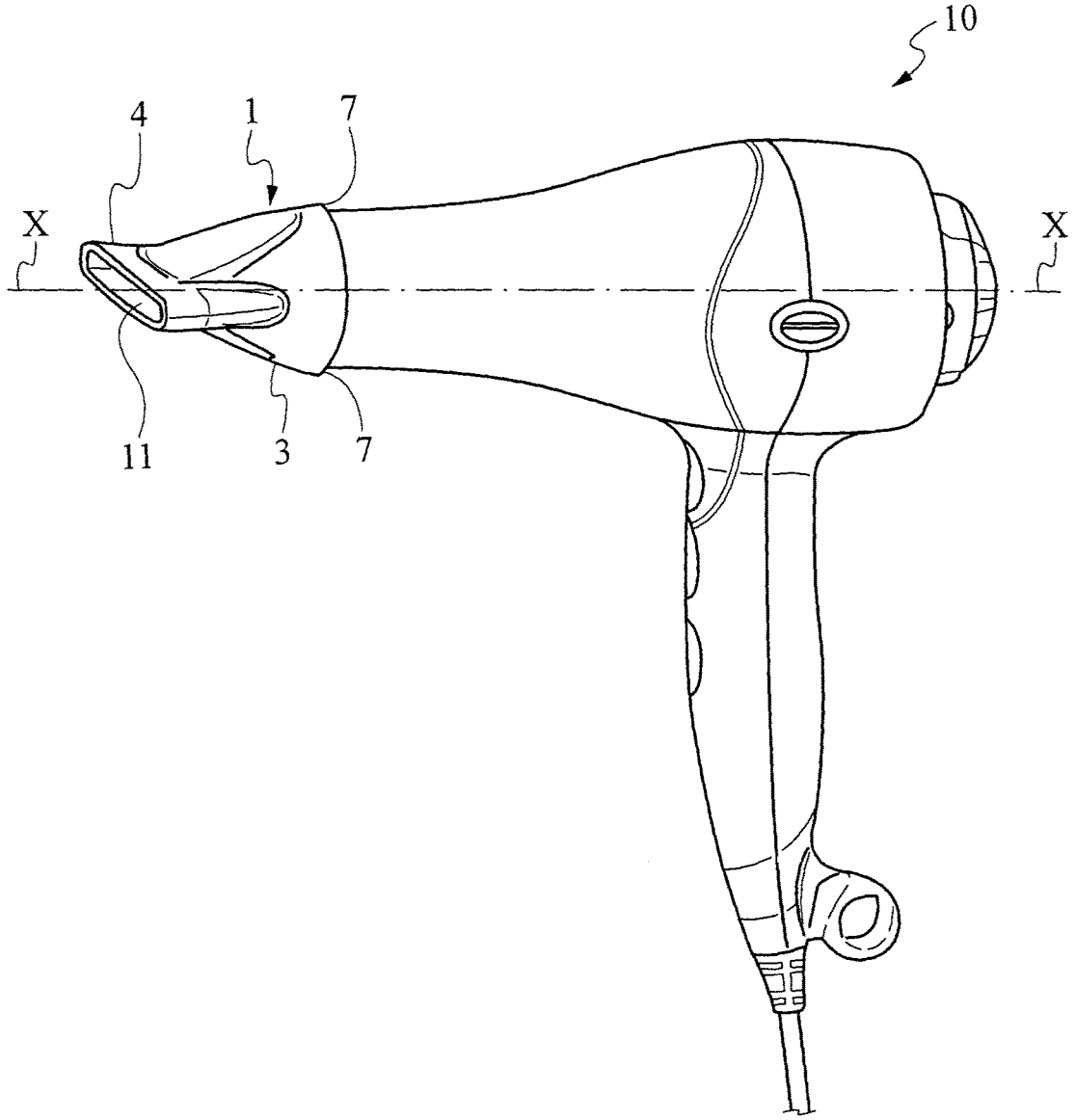
FIG. 1 is a schematic perspective view of a hair dryer provided with a front nozzle according to the present invention.
Figure 2:
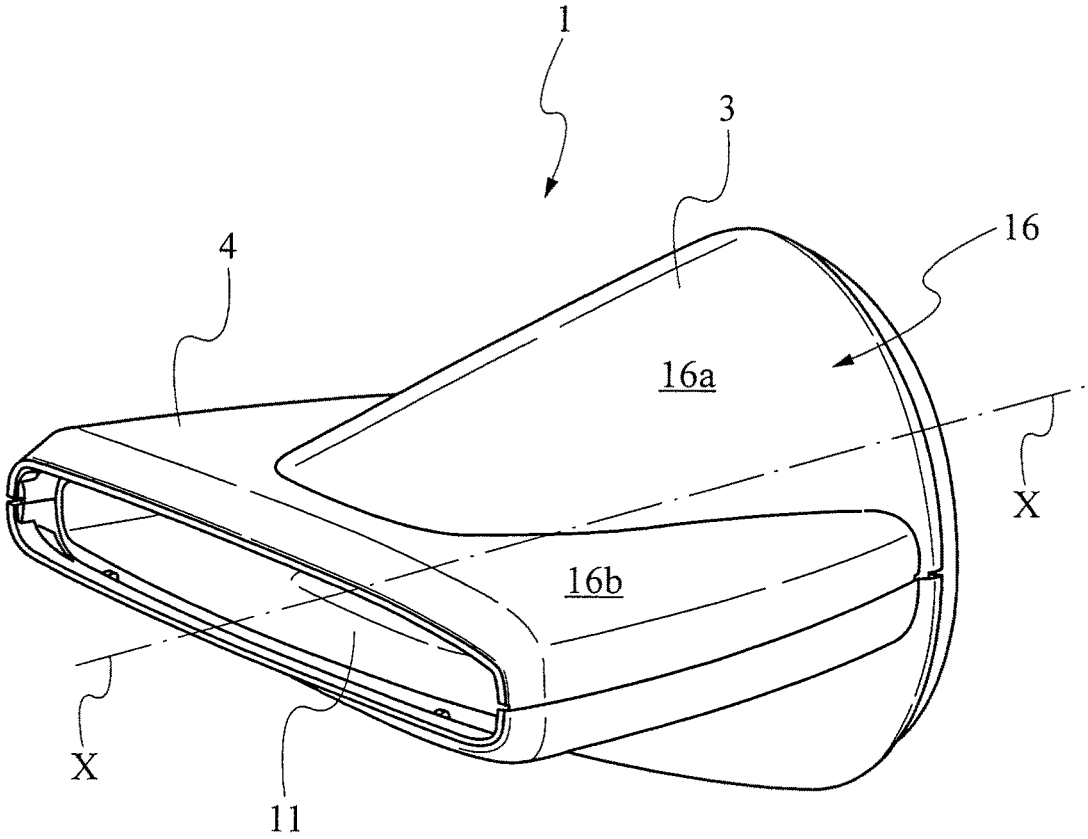
FIG. 2 is a schematic view of a front nozzle according to the present invention.

Referring to FIGS. 1-6, a nozzle for hair dryer according to the present invention, is identified with the reference numeral 1.

The nozzle 1 is composed of a main body comprising a tapered portion 3, substantially having a truncated-cone shape, that extends in an axial direction X-X and is arranged at the distal end of the tapered portion 3, a flattened portion 4, typically having a parallelepiped shape, that substantially extends perpendicularly with respect to the axial direction X-X.

The flattened portion 4 is in fluid connection with the tapered portion 3 and has a front slit 11 placed at the end opposite, in the axial direction, to the tapered portion 3.

The front nozzle 1 has a main channel 5 of the air flow that conveys the air flow coming from the typically front opening of the hair dryer to a flow passing through the front nozzle 11 of the flattened portion 4.

Therefore, the main channel 5 extends axially from the back opening of the nozzle, i.e. the opening contacting the front opening of the hair dryer, to the front opening 11 of the nozzle 1 itself.

Figure 3:
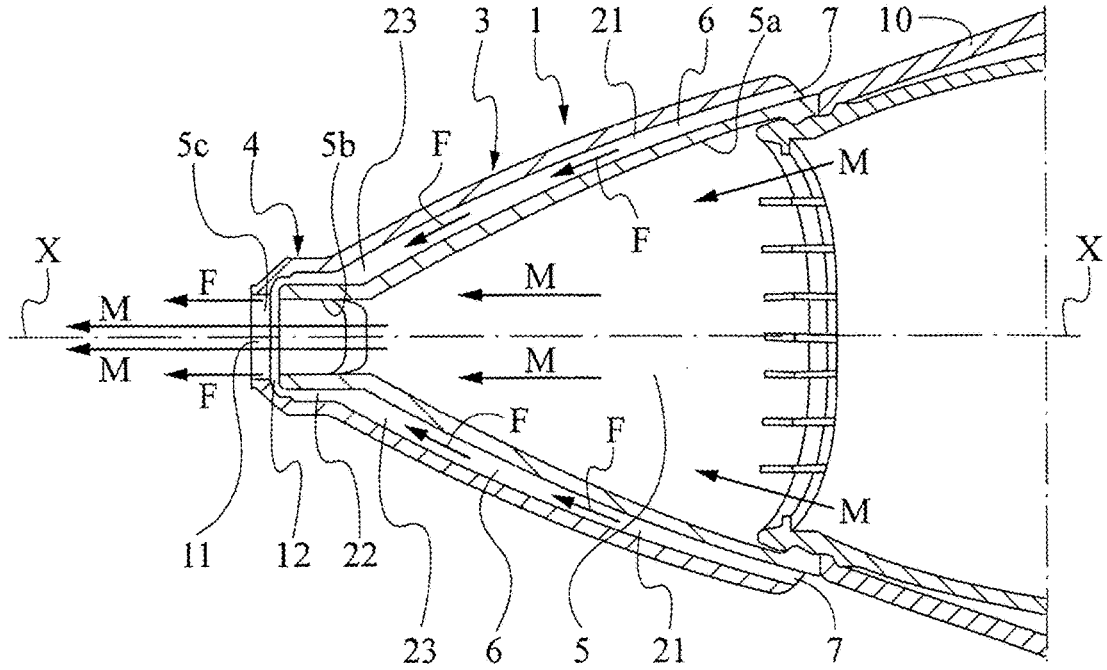
FIG. 3 is a side section view of the front nozzle of FIG. 2.

The main channel 5, as better visible in FIG. 3, comprises a converging portion 5*a*, a constant portion 5*b*, i.e. a constant section and a diverging section 5*c*.

The converging portion 5*a* converges in the direction of the front opening 11.

The nozzle 1 further has at least one secondary channel 6 comprising at least one opening 7 at the outside of the nozzle 1 and at least one front opening 12 placed downstream of the tapered portion 3.

Figure 4:
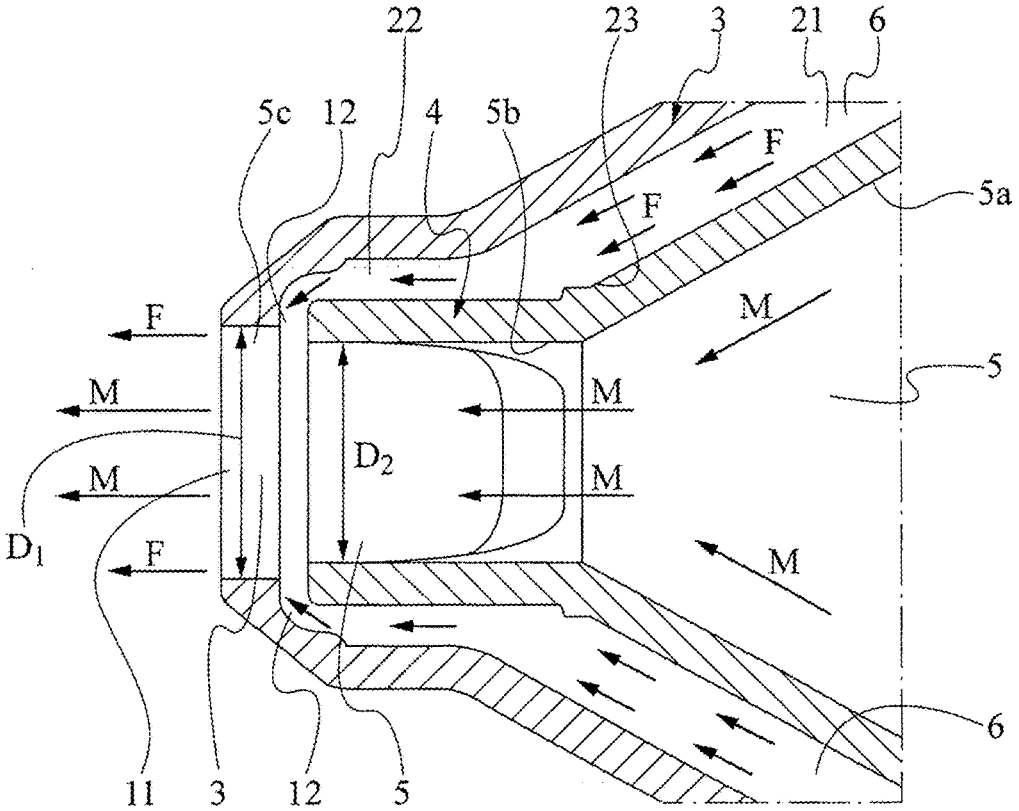
FIG. 4 is a magnified side section view of the front nozzle of FIG. 2.
Figure 5:
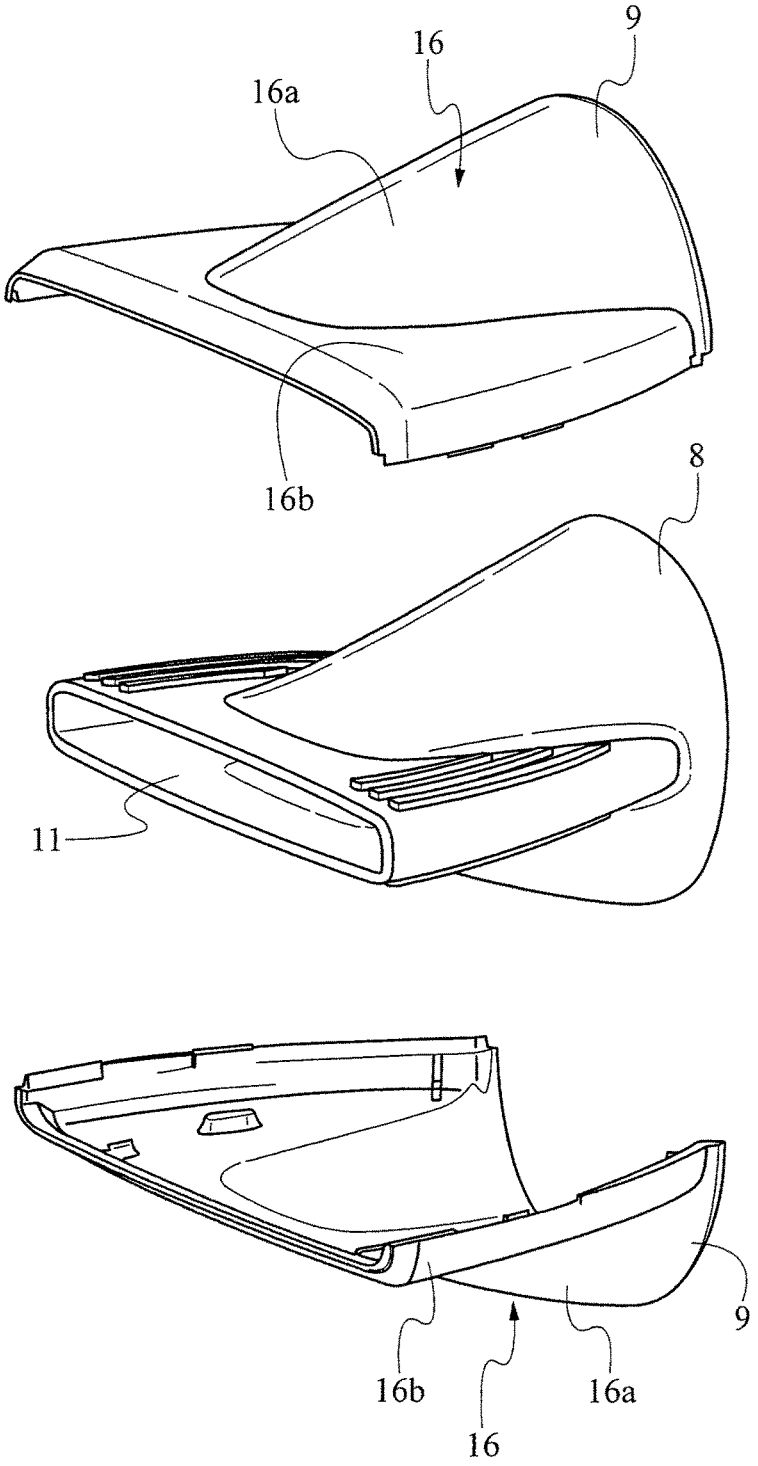
FIG. 5 is an exploded view of the front nozzle shown in FIG. 2.

The secondary channel 6 then makes a secondary air flow, indicated in FIGS. 3, 4 by the arrows F, usually cold i.e. substantially at room temperature, contact with the primary air flow passing through the main channel 5, indicated in FIG. 3, 4 by the arrows M.

The front opening 12 is arranged downstream of the converging portion 5*a* with respect to the main channel 5, preferably downstream of the constant portion 5*b*.

Preferably, the front opening 12 is arranged, referring to the main channel 5, on the diverging portion 5*c* thereof, as better described hereinafter.

The secondary channel 6 preferably extends in the axial direction substantially from the proximal end of the tapered portion 3 to the front opening 11 of the nozzle 1.

The secondary channel 6 preferably extends on the tapered portion 3 so as to create an air chamber 21 insulating the outer surface 16*a* of the tapered portion 3 then reducing the heat transfer coming from the primary air flow M passing through the main channel 5.

The secondary channel 6 extends over the tapered portion 3 so as to create at least one air chamber 21 extending at least for the 30% of the outer surface 16*a* of the tapered portion, preferably for at least the 70% of the outer surface 16*a* of the tapered portion 3, still more preferably for at least the 90% of the outer surface 16*a* of the tapered portion 3.

In the embodiment shown in figures, the secondary channel 6 also extends over the flattened portion 4 so as to create an air chamber 22 insulating the outer surface 16*b* of the flattened portion 4.

The secondary channel 6 is, on the flattened portion 3, variable in cross-section along its axial extent.

In detail, the secondary channel 6 has a section increasing from the proximal end of the tapered portion 3, i.e. the portion closed to the hair dryer 10, to the portion of distal end 23 of the tapered portion, i.e. the portion contacting with the flattened portion 4.

The secondary channel 6 extends over the flattened portion 4 so as to create an air chamber 22 extending at least for the 30% of the outer surface of the flattened portion 4, preferably for at least the 70% of the outer surface 16*b* of the flattened portion 4, still more preferably for at least the 90% of the outer surface 16*b* of the tapered portion 4.

In the embodiment shown in figures, the air chamber 21 insulating the outer surface 16*a* of the flattened portion 3, is one with the air chamber 22 insulating the outer surface 16*b* of the flattened portion 4.

For this purpose, in the embodiment shown in figures, the nozzle 1 is made of two jackets: an inner 8 and an outer 9 ones, substantially having a corresponding shape.

The outer jacket 9 overlies the inner jacket 8 so as to form the secondary channel 6 as interposed between said two jackets, and then the afore described air chamber, comprising the air chamber 21, 22.

In the embodiment shown in figures, the outer jacket 9 overlies the inner jacket 8 completely, and the secondary channel 6 is then formed in the interspace between the outer jacket 9 and the inner jacket 8.

There is a radial clearance between the outer jacket 9 and the inner jacket 8 along the secondary channel 6, the radial clearance not being constant along the secondary channel, but being variable.

Particularly, on the flattened portion 3 the radial clearance is such that it increases as axially moving from the proximal end of the tapered portion 3 to its proximal end 23.

On the other hand, as visible in figure, if moving in an axial direction on the flattened portion 4, the radial clearance between the outer jacket 9 and the inner jacket 8 is initially decreasing and subsequently substantially constant.

In the axial direction, the outer jacket 9 protrudes with respect to the inner jacket 8 and maintains such a clearance between the outer jacket 9 and the inner 8 to create the front opening 12.

In other terms, referring to the embodiment shown in figures, the front opening 12 is made by the offset between the ends of the outer jacket 9 and the inner jacket 8.

On the other hand, referring to section views of FIGS. 3 and 4, considering the proximal ends of the outer jacket 9, i.e. the upper and the lower proximal end with respect to the X-X axis, it can be observed that they are placed at a relative distance D1 in a substantially perpendicular direction to the axial direction X-X.

Similarly, always referring to the same figures, it can be observed that the proximal ends of the inner jacket 8 are placed at a distance D2 in a direction perpendicular to the axial direction X-X.

D2 is smaller than D1; in this way, as represented in FIG. 4, the secondary channel 6 has a last diverging length defined among the proximal ends of the outer 9 and inner 8 jackets and the front opening 12 is just made at the diverging portion.

Because of the shape and the positioning of the secondary channel 6 with respect to the main channel, a Venturi effect is created that draws the outer air through the channel 6 up to the front opening 12 where it contacts the hot air coming from the main channel 5.

The air flowing along the secondary channel 6 cools the outer surface 16*a*, 16*b* of the inner jacket of the tapered portion 3 and of the flattened portion 4, thereby reducing the heat transfer from the outer surface 16*a*, 16*b* of the tapered 3 and flattened 4 portions to the outer jacket 9.

In this way, the outer surface 16 of the outer jacket 9 has low temperature and can be handled by the user with no problems.

Figure 6:
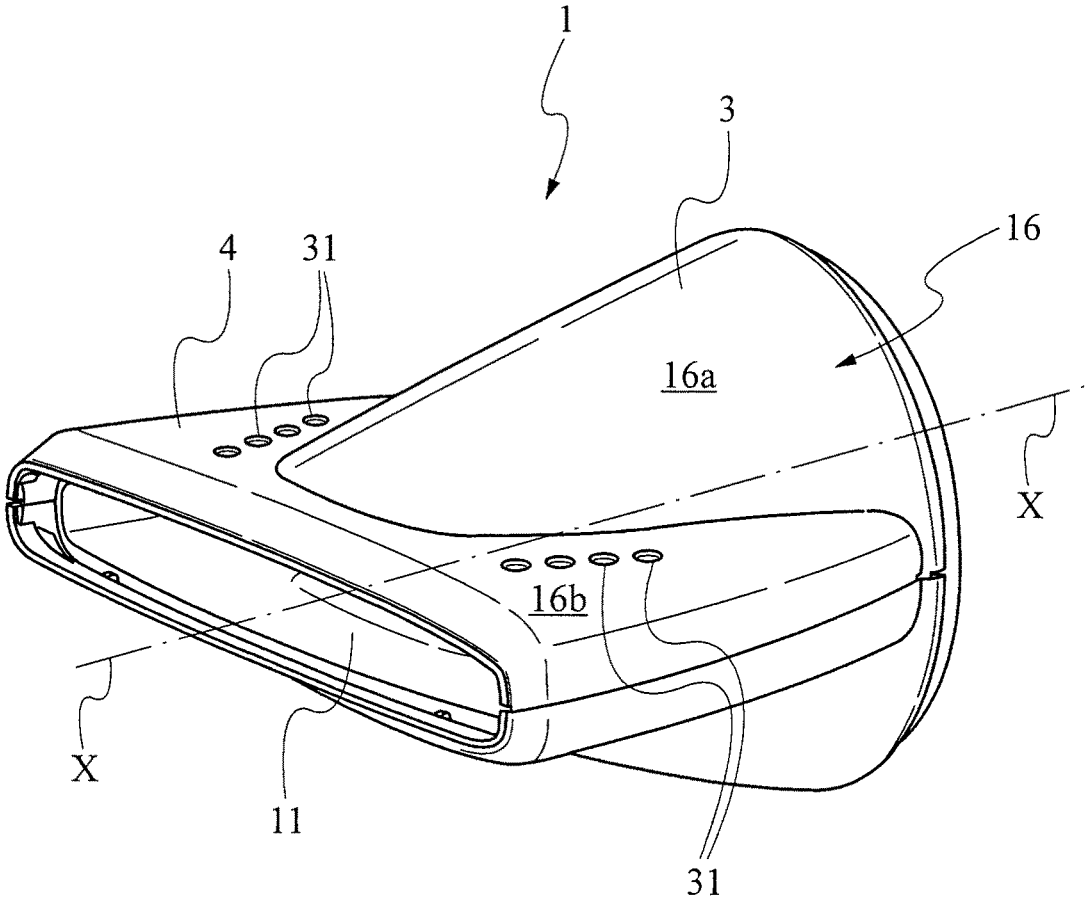
FIG. 6 is a schematic view of a second embodiment of the front nozzle according to the present invention.

In FIG. 6 an alternative embodiment of the front nozzle 1 is shown, according to the present invention completely similar to the embodiment shown in FIG. 1, except for the presence of a plurality of ventilation holes on the flattened portion 4.

Each ventilation hole 31 fluidically communicates the outside of the front nozzle 1 with the secondary channel 6, in other terms, it extends from the outer surface 16*b* of the flattened portion 4 to the secondary channel 6.

Preferably, the ventilation holes 31 have altogether a cross-section in the range from 2 $mm^2$ to 100 $mm^2$.

In the embodiment shown in detail in FIG. 6, there are two series of holes 31 arranged as opposed and symmetrically with respect to the X-X axis, however a different number of ventilation hole can be present, or they can be arranged differently without falling outside of the protection scope of the present invention.

The present invention has been described referring to some embodiments. To the embodiments herein represented in detail various modifications can be made, anyway remaining in the protection scope of the invention, defined by the following claims.

The invention claimed is:

1. A front nozzle for hair dryer, comprising:

at least one tapered portion (3) extending along an axis (X-X);

at least one flattened portion (4) extending perpendicularly to the axis (X-X); said least one flattened portion (4) being located downstream of said at least one tapered portion (3) and in fluid connection with said at least one tapered portion (3);

said flattened portion (4) having a front slit (11) at one end thereof;

at least one outer surface (16) comprising an outer surface (16*a*) of the tapered portion (3) and an outer surface (16*b*) of the flattened portion (4);

at least one main channel (5) for main air flow, said at least one main channel (5) adapted for passage there through of air flow coming from the hair dryer, said at least one main channel (5) comprising at least one converging portion (5*a*) and at least one second portion placed downstream of the at least one converging portion (5*a*);

at least one secondary channel (6) comprising i) at least one opening (7) at the outside of the nozzle (1) to accept air from outside the hair dryer and ii) at least one front opening (12) downstream of the converging portion (5*a*) of the main channel (5) to contact the air flow passing through the secondary channel (6) with the main air flow passing from the main channel (5);

said secondary channel (6) extending between the outer surface (16) and the main channel (5) so as to thermally insulate, at least partially, said outer surface (16);

said secondary channel (6) extending over the flattened portion (4) so as to create an air chamber insulating the outer surface (16*b*) of the flattened portion, wherein said at least one flattened portion (4) that is located downstream of said at least one tapered portion (3), is also located downstream with respect to the hairdryer and with respect to the air flow coming from the hair dryer.

2. The front nozzle (1) according to claim 1, wherein said second portion is a diverging portion (5*c*).

3. The front nozzle (1) according to claim 1, wherein said secondary channel (6) is variable in cross-section along its extent.

4. The front nozzle (1) according to claim 2, wherein said front opening (12) is formed at the diverging portion (5*c*) of said main channel (5) and is smaller in cross-section than the main channel (5).

5. The front nozzle (1) according to claim 2, wherein said main channel (5) further comprises a constant portion (5*b*) interposed between the converging portion (5*a*) and the diverging portion (5*c*).

6. The front nozzle (1) according to claim 1, wherein the secondary channel (6) extends over the tapered portion (3) so as to form an air chamber insulating the outer surface (16*a*) of the tapered portion (3).

7. The front nozzle (1) according to claim 1, further comprising at least one outer jacket (9) and at least one inner jacket (8); said outer jacket (9) overlying the inner jacket (8) so as to form said secondary channel (6) as interposed between said inner jacket (8) and said outer jacket (9), respectively.

8. The front nozzle (1) according to claim 7, wherein there is a radial clearance between the outer jacket (9) and the inner jacket (8) along said secondary channel (6), said radial clearance being variable along the extent of the secondary channel (6).

9. The front nozzle (1) according to claim 1, further comprising at least one ventilation hole (31) at the outer surface (16*b*) of the flattened portion (4) whereby the exterior of the front nozzle (1) communicates with said secondary channel (6).

10. The front nozzle (1) according to claim 1, further comprising a plurality of ventilation holes (31) at the outer surface (16*b*) of the flattened portion (4) whereby the exterior of the front nozzle (1) communicates with said secondary channel (6), said ventilation holes (31) having altogether a cross-section in the range from 2 $mm^2$ to 100 $mm^2$.

11. A hair dryer comprising a nozzle for hair dryer according to claim 1.

12. The front nozzle (1) according to claim 3, wherein (5*b*) interposed between the converging portion (5*a*) and the diverging portion (5*c*).

13. The front nozzle (1) according to claim 4, wherein said main channel (5) further comprises a constant portion (5*b*) interposed between the converging portion (5*a*) and the diverging portion (5*c*).

14. The front nozzle (1) according to claim 2, wherein the secondary channel (6) extends over the tapered portion (3) so as to form an air chamber insulating the outer surface (16*a*) of the tapered portion (3).

15. The front nozzle (1) according to claim 3, wherein the secondary channel (6) extends over the tapered portion (3) so as to form an air chamber insulating the outer surface (16*a*) of the tapered portion (3).

16. The front nozzle (1) according to claim 4, wherein the secondary channel (6) extends over the tapered portion (3) so as to form an air chamber insulating the outer surface (16*a*) of the tapered portion (3).

17. The front nozzle (1) according to claim 5, wherein the secondary channel (6) extends over the tapered portion (3) so as to form an air chamber insulating the outer surface (16*a*) of the tapered portion (3).

18. The front nozzle (1) according to claim 2, further comprising at least one outer jacket (9) and at least one inner jacket (8); said outer jacket (9) overlying the inner jacket (8) so as to form said secondary channel (6) as interposed between said inner jacket (8) and said outer jacket (9), respectively.

19. The front nozzle (1) according to claim 2, further comprising at least one ventilation hole (31) at the outer surface (16*b*) of the flattened portion (4) whereby the exterior of the front nozzle (1) communicates with said secondary channel (6).

20. A front nozzle for hair dryer, the front nozzle comprising:

a main channel (5) for main air flow therethrough, said main channel (5) having an inlet adapted for receiving air flow coming from the hair dryer, said main channel (5) comprising i) a converging portion (5*a*) extending away from the inlet of the channel along an axis (X-X), and ii) a second portion (5*b*) located downstream of the converging portion (5*a*), the main air flow passing through the main channel (5) and exiting from the main channel (5) via the second portion (5*b*);

a tapered portion (3) located outside an outer surface of said converging portion (5*a*) and extending along the axis (X-X);

a flattened portion (4) located outside an outer surface of said second portion (5*b*) extending along the axis (X-X) perpendicularly to the axis (X-X), said flattened portion (4) having an inlet end and an opposite, outlet end;

a front slit (11) located downstream of said flattened portion (4), said front slit (11) extending across and perpendicularly to the axis (X-X) located downstream of said flattened portion (4), wherein said tapered portion (3) and said flattened portion (4) together define a secondary channel (6) comprising i) an inlet outside air opening (7) at an outside of the nozzle (1) to accept air from outside the hair dryer and ii) a front opening (12) downstream of the converging portion (5*a*) of the main channel (5), said flattened portion (4) being located downstream of said tapered portion (3) and in fluid connection with said tapered portion (3) such that the inlet end of said flattened portion (4) receives the air flow from said secondary channel (6) from a discharge end of said tapered portion (3) and discharges the received air flow from said secondary channel (6) via the front opening (12) at an inlet side of the front slit (11) to contact the main air flow exiting from the main channel (5), wherein said secondary channel (6) thermally insulates, at least partially, an outer surface (16) of said tapered portion (3) and an outer surface (16*a*) of said flattened portion (4), and wherein said flattened portion (4) that is located downstream of said tapered portion (3), is also located downstream with respect to the hairdryer and with respect to the air flow coming from the hair dryer.

* * * * *